US007807097B1

(12) United States Patent
Tucker

(10) Patent No.: US 7,807,097 B1
(45) **Date of Patent: *Oct. 5, 2010**

(54) ORBITAL FABRICATION OF ALUMINUM FOAM AND APPARATUS THEREFORE

(75) Inventor: Dennis S. Tucker, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 53 days.

This patent is subject to a terminal disclaimer.

(21) Appl. No.: 12/123,170

(22) Filed: May 19, 2008

(51) Int. Cl.
*B22D 7/00* (2006.01)

(52) U.S. Cl. ..... 266/213; 266/217; 266/248; 266/235; 164/79

(58) Field of Classification Search ..... 266/248, 266/217, 235, 213
See application file for complete search history.

(56) References Cited

U.S. PATENT DOCUMENTS

| | | | | |
|---|---|---|---|---|
| 3,005,700 | A | 10/1961 | Elliot | |
| 3,647,924 | A | 3/1972 | Rasquin | |
| 3,941,182 | A | 3/1976 | Bjorksten et al. | |
| 4,168,182 | A | 9/1979 | Rossmann et al. | |
| 4,314,835 | A | 2/1982 | Pelton | |
| 4,480,677 | A | 11/1984 | Henson et al. | |
| 4,677,642 | A | 6/1987 | Robinson et al. | |
| 4,973,358 | A | 11/1990 | Jin et al. | |
| 6,263,953 | B1 | 7/2001 | Emil | |
| 6,508,854 | B2 | 1/2003 | Minagawa et al. | |
| 6,889,744 | B2 | 5/2005 | Keetman et al. | |
| 6,930,304 | B2 | 8/2005 | Schubert | |
| 7,594,530 | B1 * | 9/2009 | Tucker | 164/79 |
| 2006/0269434 | A1 * | 11/2006 | Ecer | 419/2 |

* cited by examiner

*Primary Examiner*—George Wyszomierski
*Assistant Examiner*—Tima M McGuthry-Banks
(74) *Attorney, Agent, or Firm*—Norton R. Townsley; James J. McGroary

(57) ABSTRACT

A process for producing foamed aluminum in space comprising the steps of: heating aluminum until it is molten; applying the force of gravity to the molten aluminum; injecting gas into the molten aluminum to produce molten foamed aluminum; and allowing the molten foamed aluminum to cool to below melting temperature. The apparatus for carrying out this invention comprises: a furnace which rotates to simulate the force of gravity and heats the aluminum until it is molten; a door on the furnace, which is opened for charging the aluminum into the furnace, closed for processing and opened again for removal of the foamed aluminum; a gas injection apparatus for injecting gas into the molten aluminum within the furnace; and an extraction apparatus adjacent the door for removing the foamed aluminum from the furnace.

7 Claims, 2 Drawing Sheets

ORBITAL FABRICATION OF ALUMINUM FOAM AND APPARATUS THEREFORE

GOVERNMENT EMPLOYEE INVENTION

The invention described herein was made by an employee of the United States Government and may be manufactured and used by or for the Government of the United States of America for governmental purposes without the payment of any royalties thereon or therefor.

BACKGROUND OF THE INVENTION (1) Field of the Invention

The present invention relates to the field of extrusion and more particularly to the field of extruded foam structural shapes.

(2) Description of the Related Art

Low gravity forming of metals is normally accomplished with a mold within a furnace so that only small specimens can be made. A number of patents have to do with forming metal foams.

U.S. Pat. No. 3,005,700 discloses a process of producing foamed metal by melting a metal, continuously introducing it into a reaction chamber by gravity flow, continuously introducing a solid state thermally decomposable foaming agent into the reaction chamber and intermixing the metal and foaming agent in the reaction chamber. The foaming agent is decomposed by the heat of the metal to cause foaming of the metal. The foamed metal is expelled from the reaction chamber by expansive force of metal foaming in the chamber. Then the transferred metal then is allowed to cool to provide solidified foam metal product.

U.S. Pat. No. 3,647,924 discloses an electrically powered furnace for melting high-melting point materials in the vacuum and zero gravity environment of space comprising an alumina crucible, cylindrical in shape, and enclosing a cylindrical tantalum sample holder that contains the sample to be melted. The crucible is surrounded by concentric cylindrical enclosures made of polished sheet molybdenum. The sample holder is clamped between a pair of round plates and a pair of alignment bolts are joined to the circular plates and extend along the longitudinal axis of the furnace through the end covers of the crucible and surrounding concentric enclosures.

U.S. Pat. No. 3,941,182 discloses steel wires are pulled through a reactor tube in which they continuously interact with a foaming metal mass. The steel wires are coated with a metal which forms a binary alloy with the matrix metal, thereby protecting the steel from being dissolved. The foaming matrix metal is usually aluminum alloy but can be any light or low melting metal including zinc or lead. The steel wires protect the metal foam from cracking in the pultrusion process.

Patent Number 4,677,642 discloses an electron bombardment furnace (B) which consists of two confinement grid sections (26, 28) which may be moved and separated from each other. Inside the bombardment furnace, a tungsten element (14) is enclosed. The material specimen (18) is located within the tungsten element and grounded by means of grounded support wires (20, 22) connected to the respective sections of the furnace. The material specimen (18) is supported on the ground wires and heated by electron bombardment until melt occurs. The furnace sections are separated in opposite directions causing the ground wires to pull from the surfaces of the specimen, leaving the specimen freely suspended in the process chamber without the action of external forces. The specimen remains in its melt condition in the processing chamber where it can be undercooled without external forces acting on the specimen, which would cause dynamic nucleation.

U.S. Pat. No. 4,168,182 discloses a shaped metal base component being formed, such as by casting or forging. The component is then thinly coated with a material, such as a ceramic material, having a higher melting point than the material of the shaped component. The coated component is then heated under zero gravity conditions up to a temperature which is below the melting point of the coating, but which is high enough to soften the component, the coating maintaining the shape of the component during the heating step. After completion of the heating step, the coated component is cooled under zero gravity conditions. The forming and coating of the component take place on earth, and the steps of heating and cooling the coated component are performed in space. After cooling the coated component, the coating is either stripped off the component or left on the component to form an integral part of the shaped body.

U.S. Pat. No. 4,314,835 discloses an improved article made of foamed glass or similar materials and method of manufacture. Thus, a construction panel may be formed to bear weight, withstand weather and take reasonable impact and abuse, because of a tempered outer skin supported inside by a skeletal network of solid, poreless material formed about low density pockets of substantially constant size and frequency. These panels are made by continuous pulling of the panels through a heat controlled mold in contact with the surface skin from a continuously fed molten mass into which is injected from the bottom size and frequency controlled foaming agents or gaseous bubbles which rise in the molten mass to a position where they are frozen in place.

U.S. Pat. No. 4,480,677 discloses an apparatus and methods whereby materials may be processed and formed in space utilizing the special conditions of space to great advantage. More specifically, methods and apparatus are presented which vaporize substances on a variety of forms. The processing steps required are: a. heat a material (not necessarily a metal) to form a vapor; b. direct the vapor, and c. deposit the material on a form. To provide the energy required for this process, sunlight is concentrated by a mirror, directed through an aperture, converted to heat by absorption, and the heat conducted to a cavity where metals such as steel or aluminum, are vaporized. The metal is fed into the cavity in the form of a rod. The resultant metal vapors are expanded through a nozzle and directed to a temperature controlled inflated form which may be rotated in the path of the metal vapor beam. This fabrication method seems particularly well suited for forming seamless pressure vessels on inflated forms, or flat surfaces on endless belts, but is not limited to such shapes and forms. Objects with complex internal structure may be formed provided the surfaces are locally flat or have smooth curves. The metallurgy of vapor deposited metals in particular is well understood and a large number of patents (see for example Cole, U.S. Pat. No. 3,690,333) have been obtained in this field for the use of vapor deposition for coating substrates.

U.S. Pat. No. 4,973,358 discloses a method for producing foamed metal in which gaseous bubbles are retained within a mass of molten metal during foaming. The method comprises heating a composite of a metal matrix and finely divided solid stabilizer particles above the liquidus temperature of the metal matrix, discharging gas bubbles into the molten metal composite below the surface thereof to thereby form a foamed melt on the surface of the molten metal composite and cooling the foamed melt thus formed below the solidus temperature of the melt to form a solid foamed metal having a plurality of closed cells.

U.S. Pat. No. 6,263,953 discloses a continuous casting method comprising the following steps: a) the material is melted and a continuous strand formed from said material; b) the material strand is cooled or left to cool so that at least a part thereof has a temperature at which its structure is pasty; c) gas is introduced into that part of the material strand which has a pasty structure so as to form hollow cavities, the material strand being moved from the top towards the bottom; and d) the material is left to solidify. The invention also relates to a device for carrying out this method.

U.S. Pat. No. 6,508,854 discloses a method of preparing a magnetostrictive material, including the steps of: (a) forming a melt of metals having a composition corresponding to the magnetostrictive material; (b) subjecting the melt to a microgravity environment; and (c) cooling the melt in the microgravity environment at a rate of at least 50° C. per second, while applying a magnetic field to the melt, to solidity the melt.

U.S. Pat. No. 6,889,744 discloses an apparatus and a method for foaming a hollow profile with metal foam. The device comprises induction means, into which the hollow profile can be introduced, in which a foamable raw material is disposed, the hollow profile having an electrical interruption, which extends in its longitudinal direction of the hollow profile, and being in contact with the induction means at least at one place, so that, during the inductive foaming of the raw material, the (56) References Cited hollow profile forms part of the induction means.

U.S. Pat. No. 6,930,304 discloses a process and apparatus for separating element isotopes in a microgravity or low-gravity environment using electromagnetic radiation, e.g., sunlight, to heat and ionize a stream of raw materials, followed by electromagnetic separation, and collection of the desired isotopes in or on one or more collection surfaces or receptacles, such as a rotating surface. A cylindrical mirror can serve to collect and concentrate the electromagnetic radiation, permitting the stream of material to be heated and ionized while the path of the stream of material is oriented other than parallel to the direction of the radiation.

None of the above listed patents describe an orbital foam extrusion apparatus or process that rotates to produce 1 g conditions. Development of an orbital foam extrusion apparatus and process which can rotate to produce 1 g conditions represents a great improvement in the field of space construction and satisfies a long felt need of the space construction engineer.

SUMMARY OF THE INVENTION

The purpose of the innovation is to produce continuous foamed aluminum utilizing batch processing in orbit. Key features of this invention are: heating the aluminum to the melting point, inducing foaming of the melted metal, and removal of the foam from the furnace. The approach of this invention requires continuous control by a human or robotics.

This innovation will allow batch processing of foamed aluminum in orbit. Centrifugal force is used to induce gravity within the furnaces which are heated using solar energy. Injection of gas into molten aluminum will produce gas bubbles which will migrate due to buoyancy to the top of the furnaces. The metal foam is then pulled from the furnaces using a heated roller system.

This invention is a process for producing foamed aluminum in space comprising the steps of:

heating aluminum until it is molten;

applying the force of gravity to the molten aluminum;

injecting gas into the molten aluminum to produce molten foamed aluminum; and allowing the molten foamed aluminum to cool to below melting temperature to produce the foamed aluminum.

More specifically the process comprises the steps of:

placing aluminum in a furnace;

rotating the furnace to simulate the force of gravity;

heating the furnace until the aluminum is molten;

injecting gas into the molten aluminum to produce molten foamed aluminum;

extracting the foamed aluminum from the furnace; and allowing the molten foamed aluminum to cool to below melting temperature to produce the foamed aluminum;

The apparatus for carrying out this invention comprises:

a furnace which rotates to simulate the force of gravity and heats the aluminum until it is molten;

a door on the furnace, which is opened for charging the aluminum into the furnace, closed for processing and opened again for removal of the foamed aluminum;

a gas injection apparatus for injecting gas into the molten aluminum within the furnace; and an extraction apparatus adjacent the door for removing the foamed aluminum from the furnace.

Heating is accomplished by concentrating solar energy on the furnace. Preferably the aluminum is in powder form. The gas injection apparatus comprises a supply of gas exterior to the furnace connected to an impeller located within the furnace. Preferably the extraction apparatus comprises a heated roller. Preferably the apparatus includes an aluminum charging apparatus, which comprises a supply of powdered aluminum and a bellows which can be extended and retracted into the furnace through the door, when it is open.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
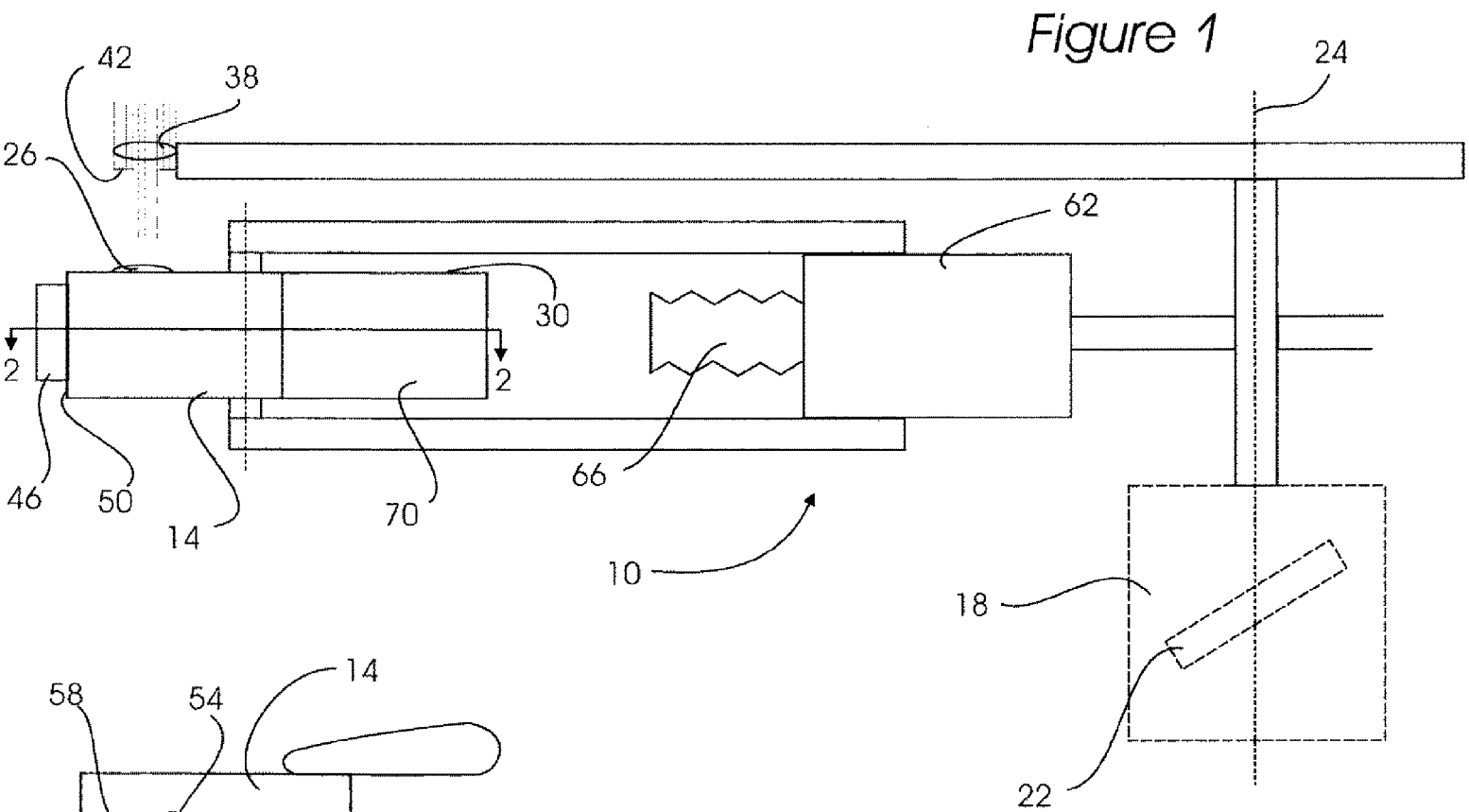
FIG. 1 is a side elevational view of a preferred apparatus for carrying out the process of this invention.
Figure 2:
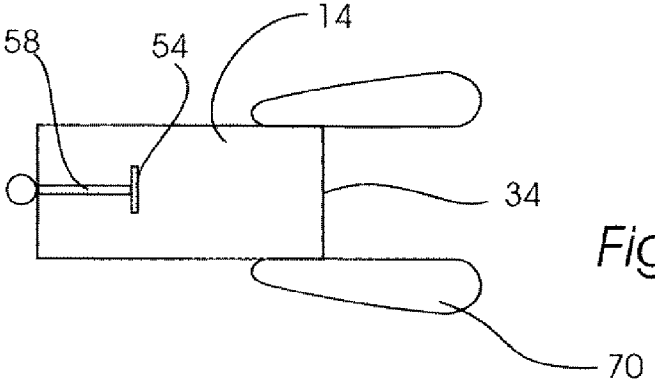
FIG. 2 is a cross sectional view along the line 2-2 of FIG. 1.

The preferred apparatus 10 for practicing this invention is illustrated in FIGS. 1 and 2. It should be understood that FIG. 1 shows about one half of the apparatus 10, the other half being a mirror image of the half illustrated, and FIG. 2 illustrates a furnace 14. Referring to these Figures, the facility for practicing this invention 10 is attached to a spacecraft 18 bus powered by solar cells 22. As the bus 18 rotates around its rotational axis 24, the facility 10 also rotates. Include in the facility 10 are at least two furnaces 14 located at a distance from the bus 18. The furnaces 14 are blackbodies on the inside. Each furnace 14 has a focusing lens 26 on the surface 30 facing the sun and a door 34 on the side facing the bus 18. Located on the sunward side of the lens 26 is a Fresnel lens 38 to focus the sunlight on the lens 26. A stop or iris 42 on the Fresnel lens 38 is used to control the amount of sunlight passing through the lens 26 and thus the temperature in the furnace 14. Gas containers 46 are located on the rear 50 of each furnace 14. Gas is fed into the furnace 14 through a rotor 54 to which an impeller 58 is attached. This is used to stir and mix the gas uniformly into the melt. also included in the facility 10 are containers 62 for the aluminum powder to be fed into each furnace 14 though retractable bellows lines 66. The doors 34 of the furnaces 14 are opened to permit loading of the metal into the furnaces 34. There are heated roller systems 70 on each furnace 14 to extract the foamed aluminum 78 from the furnaces 70. The roller systems 70 may also be pivotable.

In operation the spacecraft bus 18 is spun up to a rate to induce gravity in each furnace 14. The spin rate is controlled to control the amount of gravity. The amount of gravity influences the buoyancy of the bubbles in the foam, which influences the segregation of bubbles and thus the porosity of the foam. The door 34 on each furnace 14 is opened and the retractable bellows 66 is extended into each furnace 14. There will be a gravity gradient from low to high from the containers 62 to the furnaces 14 which will induce flow of the powder into the furnaces 14. Once the powder is in the furnaces 14, the bellows tubes 66 are retracted, the doors 34 are closed and sunlight is focused into each furnace 14 until the aluminum alloy is molten. Gas is injected through the rotors 54 into the melted metal while the impeller 58 is turning. Buoyancy will drive the gas bubbles toward the low gravity end of the furnace 14 while drainage of the melt occurs resulting in aluminum foam. If the amount of metal initially charged into the furnace 14 is large enough, the foam will extrude out of the furnace 14. The door 34 will be unlatched to permit this. Alternatively, the amount of metal could be kept small enough so that the foam just fills the furnace 14. Either way, the roller systems 70 will draw the foam out of the furnaces 14. The rollers 70 are heated and the system is designed and controlled so that the foam 78 stays hot and plastic enough to be completely extracted from the furnaces 14, free of the impellers 54. Then the foam 78 is allowed to cool.

Figure 4:
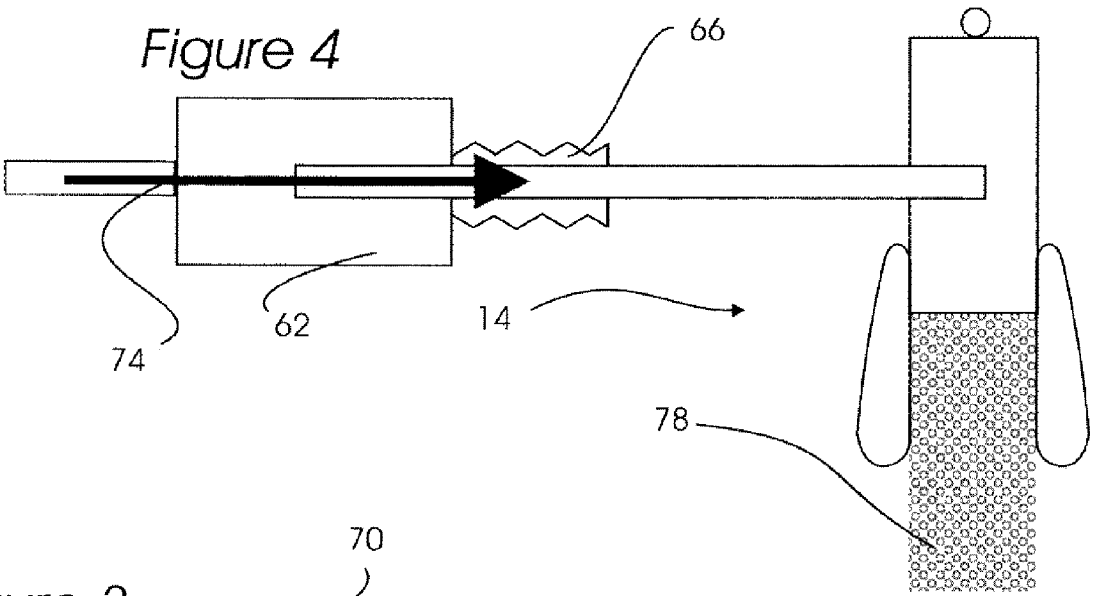
FIG. 4 is a top view illustrating aluminum foam being extracted from the furnace while the furnace is pivoted at an angle to the gravity vector.
Figure 3:
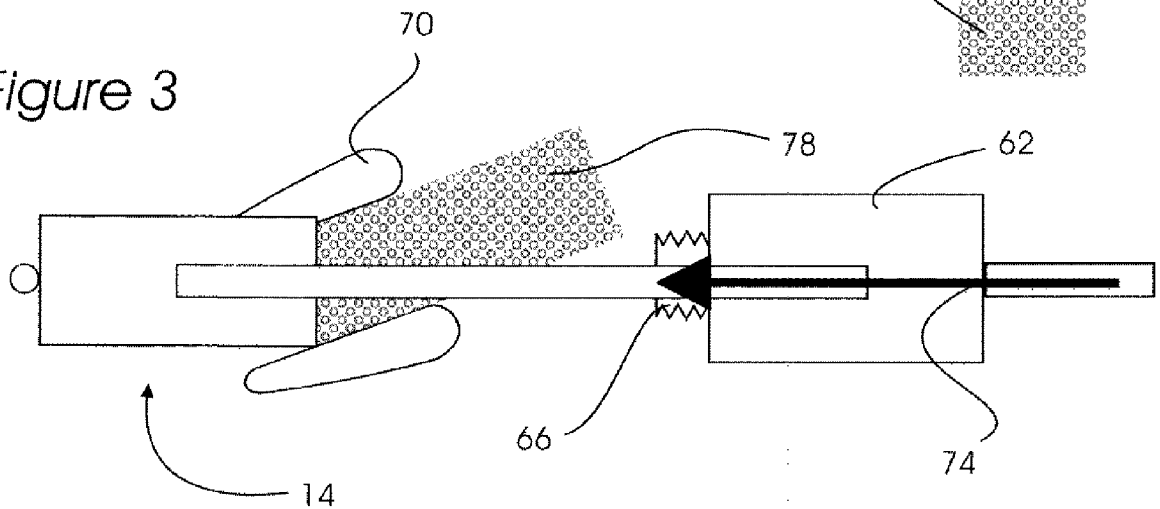
FIG. 3 is a top view illustrating aluminum foam being extracted from the furnace with rollers at an angle to the gravity vector.

In order to prevent the foam 78 from extruding into the containers 62, the furnaces 14 are pivotable to an angle from the gravity vector 74. See FIG. 4. Alternatively, the heated rollers 70 can be designed so that they run at an angle to the gravity vector 74. See FIG. 3.

Novel features include rotating the facility 10 to achieve gravity to induce bubble buoyancy, utilization of Fresnel lens 38 to melt the aluminum alloy and the fact that this is an autonomous facility. The advantage of this innovation is that it can be used in low lunar orbit or in low Mars orbit. There is abundant aluminum tied up in the lunar and Martian regoliths which can be processed to produce aluminum. The aluminum can be ground to powder, small particles or chunks, launched to the facility 10 and used to produce continuous aluminum foam 78 for use in orbital structures. The vacuum of space is also used to aid in the foaming process.

The following reference numerals are used on FIGS. 1 through 4:

10 apparatus for carrying out the process of this invention
14 furnace
18 spacecraft bus
22 solar panels
26 focusing lens
30 surface of furnace facing sun
34 door of furnace
38 Fresnel lens
42 stop or iris
46 gas cylinder
50 rear of furnace
54 rotor
58 impeller
62 container for metal
66 retractable metal feed bellows
70 heated roller
74 gravity vector
78 aluminum foam Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for producing foamed aluminum in space comprising:

a) a furnace which rotates to simulate the force of gravity and heats said aluminum until it is molten;

b) a door on said furnace, which is opened for charging said aluminum into said furnace, closed for processing and opened again for removal of said foamed aluminum;

c) a gas injection apparatus for injecting gas into said molten aluminum within said furnace; and d) an extraction apparatus adjacent said door for removing said foamed aluminum from said furnace.

2. An apparatus as claimed in claim 1 in which heating is accomplished by concentrating solar energy on said furnace.

3. An apparatus as claimed in claim 1 in which said aluminum is in powder form.

4. An apparatus as claimed in claim 1 in which said gas injection apparatus comprises a supply of gas exterior to said furnace connected to an impeller located within said furnace.

5. An apparatus as claimed in claim 1 in which said extraction apparatus comprises a heated roller.

6. An apparatus as claimed in claim 1 further comprising an aluminum charging apparatus.

7. An apparatus as claimed in claim 6 in which said aluminum charging apparatus comprises a supply of powdered aluminum and a bellows which can be extended and retracted into said furnace through said door, when it is open, for charging said furnace with aluminum.

* * * * *